US005480082A

United States Patent [19]

Yasuga

[11] Patent Number: 5,480,082

[45] Date of Patent: Jan. 2, 1996

[54] TILE CUTTER

[75] Inventor: Masaki Yasuga, Osaka, Japan

[73] Assignee: Sankeibutusan Co., Ltd., Osaka, Japan

[21] Appl. No.: 280,439

[22] Filed: Jul. 26, 1994

[30] Foreign Application Priority Data

Aug. 5, 1993 [JP] Japan ..... 5-194521

[51] Int. Cl.[6] ..... B28D 1/24

[52] U.S. Cl. ..... 225/96.5; 125/23.02; 83/886

[58] Field of Search ..... 225/96.5; 125/23.01, 125/23.02; 83/886

[56] References Cited

U.S. PATENT DOCUMENTS 4,026,262 5/1977 Yasuga ..... 125/23.02

4,693,232 9/1987 Yasuga ..... 125/23.02

FOREIGN PATENT DOCUMENTS 2189188 10/1987 United Kingdom ..... 125/23.02

*Primary Examiner*—Richard K. Seidel

*Assistant Examiner*—Raymond D. Woods

*Attorney, Agent, or Firm*—Ratner & Prestia

[57] ABSTRACT

A tile cutter includes: a base body having a support ridge generally at the center in its longitudinal direction and elastic plates laid at the two sides of the support ridge; a guide rail erected over the support ridge and extending in parallel with the support ridge; and a tile cutting lever supported slidably on the guide rail and having a cutter on the lower face of its leading end and tile pressure legs extending to its two sides. Also, a stationary post is erected integrally from the base body and fixing one end of the guide rail; a detachable post made separate of the base body is attached at the other end of the guide rail; and a replaceable auxiliary ridge is attached to the base body and the detachable post such that the detachable post is located longitudinally extended from the support ridge of the base body.

7 Claims, 3 Drawing Sheets

TILE CUTTER

BACKGROUND OF THE INVENTION

1. Field of the Invention

The present invention relates to a tile cutter to be laid on the wail or floor of a pool, a bathroom, a rest room or a kitchen for cutting tiles of ceramics or synthetic resins precisely in a desired position.

2. Related Art

The tile cutter widely used and well known in the art has the following construction. At the two end portions of a base body having a support ridge generally at the center in its longitudinal direction and elastic plates at the two sides of the support ridge, there are erected posts which are made integral with the base body on the extension of the support ridge. On these two end posts, there are supported a guide rail which is positioned Just over and in parallel with the support ridge. On the guide rail, there is slidably supported a tile cutting lever which is equipped with a cutter on the lower face of its leading end and tile pressure legs extending from the two sides thereof.

The aforementioned tile cutter of the prior art is manufactured by using the tile cutting lever as a common part and by molding the base body integrally with the posts by means of a mold. It is, however, necessary to prepare several kinds of molds for the base body in accordance with the sizes of tiles to be cut and to prepare the elastic plates to be laid on the two sides of the support ridge in conformity to the base body. These necessities raise the production cost to a remarkably high level. On the other hand, the tile cutter for cutting large-sized tiles has such a large weight as raises problems to be solved. That is, this tile cutter is inconvenient to handle and deteriorates the cutting workability.

SUMMARY OF THE INVENTION

Therefore, the present invention has an object to provide a tile cutter which can have its base body prepared at a reasonable cost by sharing the molds and the elastic plates independently of the size of tiles to be cut and which can have its weight reduced even for tiles of a large size.

In order to achieve the above-specified object, there is provided a tile cutter which comprises: a base body having a support ridge generally at the center in its longitudinal direction and elastic plates laid at the two sides of tile support ridge; a guide rail erected over the support ridge and extending in parallel with tile support ridge; and a tile cutting lever supported slidably on the guide rail and having a cutter on the lower face of its leading end and tile pressure legs extending to its two sides. The tile cutter further comprises: a stationary post erected integrally from the base body and fixing one end of the guide rail; a post made separate of the base body and fixing the other end of the guide rail; and an auxiliary ridge made replaceable and so fixed to the base body that tile post may be located on the horizontal extension of the support ridge of the base body.

As described above, the other end of the guide rail is supported by the post which is made separate of the base body and which is fixed on the replaceable auxiliary ridge so fixed on the base body as to extend horizontally from the support ridge of the base body. For the manufacture of a tile cutter for a different size of tiles to be cut, therefore, not only the tile cutting lever but also the base body and the elastic plates can be manufactured by common molds so that they can be used as common parts for the tile cutters of different kinds (or sizes). As a result, several kinds of tile cutters can be manufactured by changing the lengths of the guide rail and the auxiliary ridge. Moreover, the tile cutters for the larger and smaller sizes of target tiles can be made light to have no substantial weight difference.

Still moreover, the guide rail has its one end fixed to the stationary post, which is erected integrally from the base body, and its other end fixed on the post which is prepared separately of the base body, and this post is so fixed on the replaceable auxiliary ridge which in turn is fixed on the base body, as to extend horizontally from the support ridge of the body body. In the manufacture of tile cutters for difference sizes of tiles to be cut, the main parts, i.e., the base body, the elastic plates and the tile cutting lever can be manufactured as the common parts by their individual molds. As a result, tile cutters for various sizes can be manufactured merely by changing the lengths of the guide rail and the auxiliary ridge so that they can be provided at reasonable prices.

Furthermore, the tile cutters of various sizes can share the base body, the elastic plates and the tile cutting lever so that they can be made light with little weight difference no matter they might be used for the large or small size of target tiles. Thus, the tile cutters are convenient to handle and can improve the cutting workability.

DESCRIPTION OF THE PREFERRED EMBODIMENTS

Figure 4:
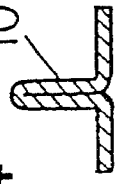

A tile cutter according to the present invention will be described with reference to the accompanying drawings. This tile cutter is constructed to include: a base body 1 made of an aluminum alloy; a guide rail 4; a tile cutting lever 7 supported slidably on the guide rail 4; a post 9 made separate from the base body 1; and a replaceable auxiliary ridge 10 having an inverted T-section (as shown in FIG. 4). The base body 1 is equipped generally at the center in the longitudinal direction with a support ridge 2 and at the two sides of the support ridge 2 with elastic plates 3 made of rubber. The base body 1 is further equipped with a stationary post 8 on an extension of one end of the support ridge 2 and is formed with a slit 11 on an extension of the other end of the support ridge 2. The guide rail 4 is laid just above the support ridge 2 and in parallel with the ridge 2. The tile cutting lever 7 is equipped on the lower face of its leading end with a cutter 5 and at its two sides with tile pressure legs 6. The auxiliary ridge 10 connects and fixes the post 9 and the portion of the slit 11 of the base body 1 on the horizontal extension of the support ridge 2.

The tile cutter thus constructed is assembled in the following procedure. The auxiliary ridge 10 is so fixed in a horizontal position in the slit 11 of the base body 1 by means of tapping screws as makes an extension of the support ridge 2. After this, the separate post 9 is firmly fixed on the free end portion of the auxiliary ridge 10 by means of tapping screws. Next, the tile cutting lever 7 is supported on the guide rail 4. This guide rail 4 is erected over the base body 1 by having its one end fixed on the stationary post 8 and its other end fixed on the post 9.

In case a tile cutter of another size is to be assembled, the major parts such as the base body 1, the elastic rubber plates 3 and the tile cutting lever 7 are used as common ones, and those of desired sizes are selected from the guide rails 4 and the auxiliary ridges 10, which have been prepared to have various lengths. The assembly per se is similar to the aforementioned one.

Figure 1:
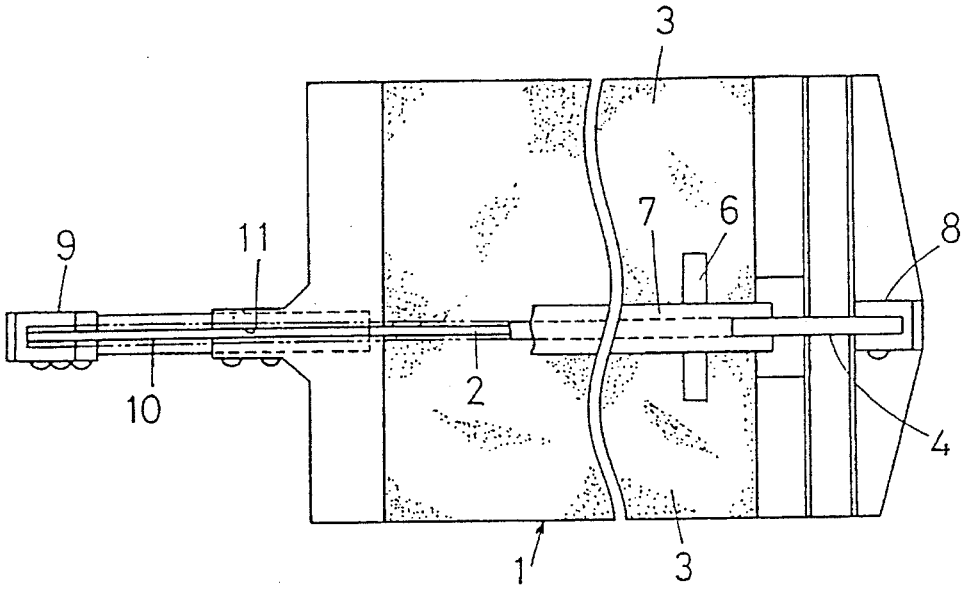
FIG. 1 is a partially cut-away top plan view showing one embodiment of a tile cutter according to the present invention.
Figure 2:
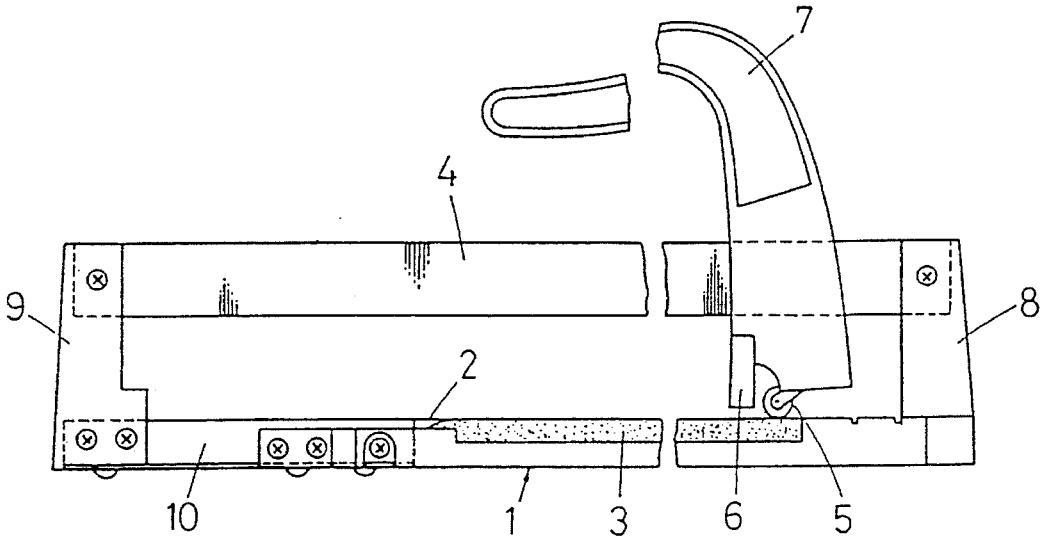
FIG. 2 is a front elevation showing the tile cutter of the present invention.
Figure 3:
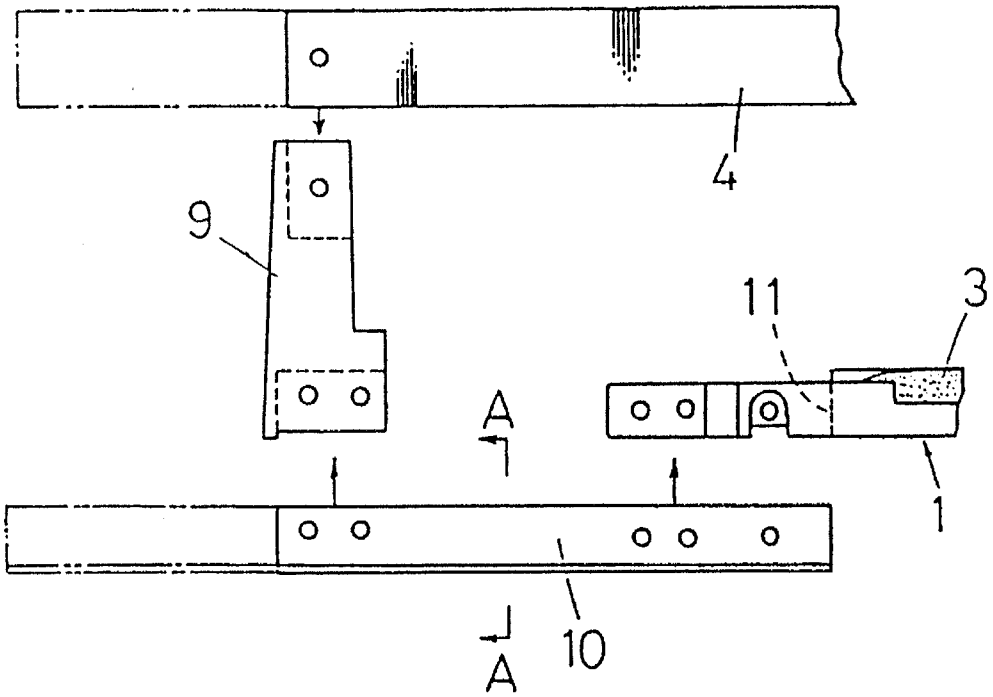
FIG. 3 is an exploded front elevation showing an essential portion of the tile cutter of the present invention.
Figure 5:
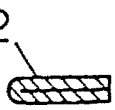
FIGS. 4 and 5 are enlarged sections taken along line A—A of FIG. 3 and show examples of an auxiliary ridge.

In the foregoing embodiment, the auxiliary ridge 10 is exemplified to have the inverted T-section but may be embodied to have an I-shaped section (which can be prepared by folding a sheet material), as shown in FIG. 5.

Figure 6:
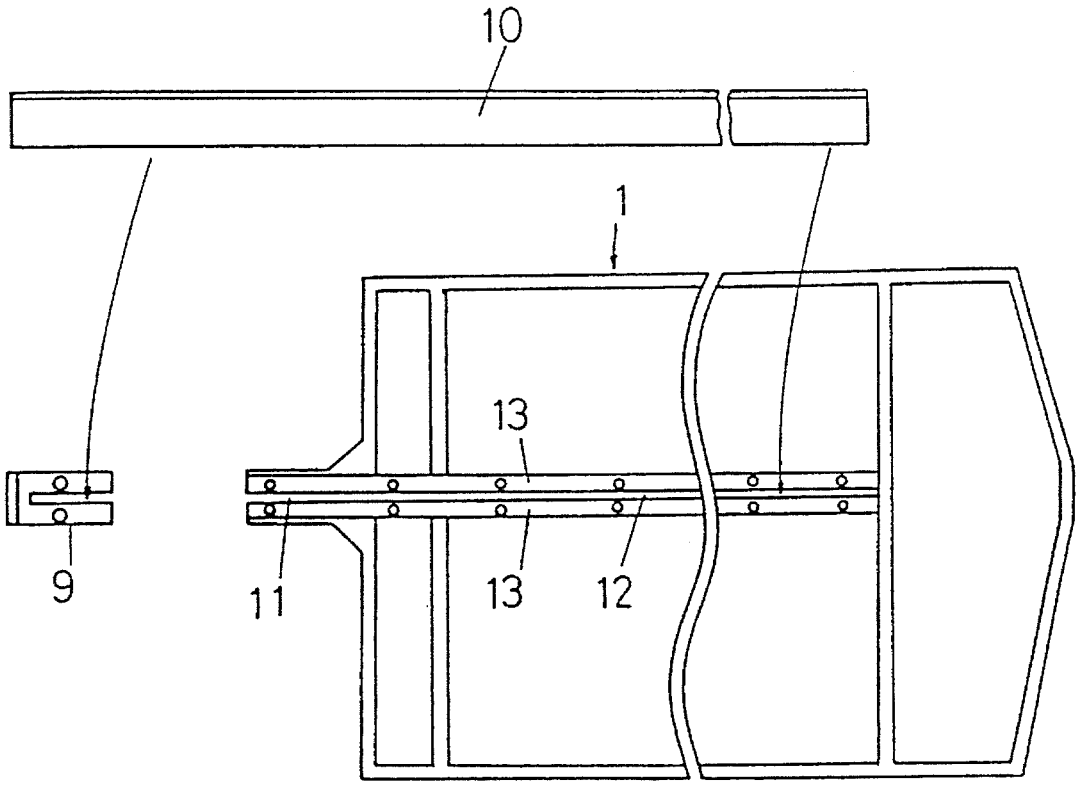
FIG. 6 is an exploded schematic view showing the bottom of another embodiment of the present invention.

As shown in FIG. 6, moreover, the auxiliary ridge 10 may be assembled in place of the support ridge 2. In this modification, an extended slit 12 is formed to extend from the slit 11 of the foregoing embodiment to the vicinity of the stationary post 8 and is equipped at the two sides of its back with fixing ribs 13. Then, the auxiliary ridge 10 (as exemplified by one having an inverted T-section) has its horizontal ridges fixed by tapping screws.

What is claimed is:

1. A tile cutter comprising: a base body extending in a longitudinal direction having a support ridge extending at a generally center position of said base body in the longitudinal direction and elastic plates laid on said base body adjacent said support ridge; a guide rail erected over said support ridge and extending in the longitudinal direction from a first end to a second end; and a tile cutting lever supported slidably on said guide rail and having a lower face of a leading end, two sides and a cutter on the lower face of the leading end and tile pressure legs extending to the two sides, wherein the improvement comprises: a stationary post erected integrally with said base body and fixing the first end of said guide rail; a detachable post separated from said base body and fixing the second end of said guide rail; and a replaceable auxiliary ridge attached to said base body and said detachable post, wherein said detachable post is located longitudinally extended from said support ridge of said base body.

2. A tile cutter according to claim 1, wherein said auxiliary ridge has an I-section as taken at a right angle with respect to the longitudinal direction.

3. A tile cutter according to claim 1, wherein said support ridge extends from said auxiliary ridge.

4. A tile cutter according to claim 1, wherein said auxiliary ridge has an inverted T-section as taken at a right angle with respect to the longitudinal direction.

5. A tile cutter comprising:

a base body extending in a longitudinal direction;

a replaceable ridge attached to said base body and extending at a generally center position of said base body in the longitudinal direction;

elastic plates laid on said base body adjacent said ridge;

a guide rail erected over said ridge and extending in the longitudinal direction from a first end to a second end;

a stationary post erected integrally with said base body and fixing the first end of said guide rail;

a detachable post separated from said base body, fixing the second end of said guide rail and attached to said ridge; and a tile cutting lever supported slidably on said guide rail and having a lower face of a leading end, two sides and a cutter on the lower face of the leading end and tile pressure legs extending to the two sides.

6. A tile cutter comprising:

a base body extending in a longitudinal direction;

a replaceable ridge attached to said base body and extending at a generally center position of said base body in the longitudinal direction;

a guide rail erected over said ridge and extending in the longitudinal direction from a first end to a second end;

a stationary post erected integrally with said base body and fixing the first end of said guide rail;

a detachable post separated from said base body, fixing the second end of said guide rail and attached to said ridge; and a tile cutting lever supported slidably on said guide rail and having a cutter.

7. A tile cutter according to claim 6, wherein said base body has a support ridge extending at a generally center position of said base body in the longitudinal direction.

* * * * *